US006644276B2

(12) United States Patent
Yoshikawa

(10) Patent No.: US 6,644,276 B2
(45) Date of Patent: Nov. 11, 2003

(54) IGNITION MOUNTING ARRANGEMENT IN INTERNAL-COMBUSTION ENGINE

(75) Inventor: Yukihiro Yoshikawa, Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 47 days.

(21) Appl. No.: 09/951,562

(22) Filed: Sep. 14, 2001

(65) Prior Publication Data

US 2002/0038648 A1 Apr. 4, 2002

(30) Foreign Application Priority Data

Sep. 28, 2000 (JP) ..... 2000-296391

(51) Int. Cl.[7] ..... F02P 5/00

(52) U.S. Cl. ..... 123/406.57; 123/149 A; 123/599; 123/149 HC

(58) Field of Search ..... 123/406.57, 599, 123/605, 149 D, 406.56, 149 A, 195 HC

(56) References Cited

U.S. PATENT DOCUMENTS

| | | | | | |
|---|---|---|---|---|---|
| 3,576,183 | A | * | 4/1971 | Miyamoto et al. | 123/406.57 |
| 3,759,237 | A | * | 9/1973 | Shino et al. | 123/643 |
| 3,884,207 | A | * | 5/1975 | Kuehn, III | 123/599 |
| 4,473,050 | A | * | 9/1984 | Kondo et al. | 123/406.57 |
| 4,528,970 | A | * | 7/1985 | Fujimoto | 123/406.57 |
| 4,924,831 | A | * | 5/1990 | Piteo et al. | 123/406.57 |
| 5,392,753 | A | * | 2/1995 | Burson et al. | 123/406.57 |

FOREIGN PATENT DOCUMENTS

JP 10-103204 A 4/1998

* cited by examiner

*Primary Examiner*—Hieu T. Vo
*Assistant Examiner*—Johnny H. Hoang
(74) *Attorney, Agent, or Firm*—Nixon & Vanderhye, P.C.

(57) ABSTRACT

A CDI ignition coil unit integrally formed of an exciter coil, pickup coil and control unit is arranged over the upper side of the engine case, at a position on the cylinder head side in proximity to the periphery of the flywheel while an ignition cord is provided to connect a spark plug located at the cylinder head to the CDI ignition coil unit.

2 Claims, 10 Drawing Sheets

IGNITION MOUNTING ARRANGEMENT IN INTERNAL-COMBUSTION ENGINE

BACKGROUND OF THE INVENTION (1) Field of the Invention

The present invention relates to an arrangement of an internal-combustion engine, and in particular relates to an ignition mounting arrangement in an internal-combustion engine.

(2) Description of the Prior Art

Conventionally, magneto ignition systems have been mainly employed as the ignition systems of internal-combustion engines having no battery or other external power supply, such as multi-purpose engines and small outboard motors.

Examples of magneto ignition systems include transistor magneto ignition system and CDI ignition system.

As shown in FIGS. 1 and 2, in a transistor magneto ignition system, a magnet 112*d* is disposed at the periphery of a flywheel 112 of an engine 100 while a core 125 of an igniter 124 is positioned over engine case 113 via spacer 114 so as to oppose the magnet 112*d*, where by a high voltage generated by the igniter 124 is applied to a spark plug 22 to achieve ignition. This method has the advantage of reducing the product cost because igniter 124 is low in cost, hence has been widely used for multi-purpose engines which are used at a fixed engine speed.

On the other hand, in a CDI ignition system, as shown in FIGS. 3 and 4, a magnet 222*d* is disposed on the inner side of a flywheel 222 of an engine 200 so as to cause an exciter coil 201 to charge a capacitor (not shown) in a CDI unit 202, whereby a high voltage is applied to a spark plug 22 by an igniter 224 disposed near a cylinder head 21 to achieve ignition. This method has the advantage of being easy in performing various controls because ignition timing can be set freely, hence has been used for engines which need relatively high-performance control. A reference numeral 203 in the drawings designates a pickup coil which detects the engine speed.

However, these conventional ignition systems have the following drawbacks. That is, the transistor magneto ignition system suffers an inconvenience that there are cases when the engine speed is low where it is impossible to obtain a high enough generation voltage compared to the required voltage, failing to provide the spark because variation in magnetic flux is too small and also there is an inconvenience of the setting of ignition timing being less flexible.

For the CDI ignition system, since exciter coil 201, pickup coil 203, CDI unit 202 and igniter 224 are all provided separately, this system needs more parts compared to the transistor magneto system, resulting in an increased cost.

In this way, the feature of the ignition system determines the characteristic of a conventional magneto ignition engine, either of a cost-oriented type or of a high-performance type. Therefore, it has been difficult to provide development of a series of various models based on one engine base to meet the demands of various users.

SUMMARY OF THE INVENTION

The present invention has been devised in view of the above conventional problems, it is therefore an object of the present invention to provide an ignition mounting arrangement in an internal-combustion engine in which either an inexpensive transistor magneto ignition system or high-performance CDI ignition system can be mounted interchangeably so as to provide a series of various models of engines such as outboard motors based on one type of engine, whereby price difference of the engines due to performance difference can be suppressed.

In order to achieve the above object, the present invention is configured as follows:

In accordance with the first aspect of the present invention, an ignition mounting arrangement in an internal-combustion engine, includes: a flywheel with a magnet, disposed at one end of the crankshaft; and an ignition coil unit having a generator coil, arranged close to the flywheel, wherein the voltage generated by the generator coil as the flywheel turns is controlled by the ignition coil unit so as to output a high voltage to a sparkplug, and is characterized in that it is possible to mount as the ignition coil unit either a CDI ignition coil unit which is integrally configured of a generator coil, an ignition timing detecting means for detecting the ignition timing based on the rotation of the flywheel and an ignition controller for controlling the ignition timing, or a transistor magneto ignition coil unit having approximately the same shape as that of the CDI ignition coil unit, and the flywheel to be mounted can be selected in accordance with the ignition type of the ignition coil unit to be mounted.

In accordance with the second aspect of the present invention, the ignition mounting arrangement in an internal-combustion engine having the above first feature is characterized in that the ignition coil unit comprises an igniter and core portions of a generator coil elements so that the core portions of the generator coil elements are arranged close to the igniter on both side thereof, sandwiching the igniter when viewed from the top, and the core portions of the generator coil elements are positioned outside the flywheel and projected closer to the magnet of the flywheel than the igniter is at the positions where they oppose the magnet.

In accordance with the third aspect of the present invention, the ignition mounting arrangement in an internal-combustion engine having the above first feature is characterized in that the engine is used as an outboard motor with the crankshaft arranged approximately vertically and the cylinder portion directed to the rear,

- the flywheel is fixed at one end of the crankshaft which is projected outside over the upper side of the engine case so that it can rotate as the crankshaft turns;
- the ignition coil unit is attached to an attachment boss projected at the top on the upper side of the engine case and is arranged on the cylinder head side along the periphery of the flywheel; and
- an ignition cord is provided to connect the spark plug located at the cylinder head to the ignition coil unit.

In accordance with the fourth aspect of the present invention, the ignition mounting arrangement in an internal-combustion engine having the above second feature is characterized in that the engine is used as an outboard motor with the crankshaft arranged approximately vertically and the cylinder portion directed to the rear,

- the flywheel is fixed at one end of the crankshaft which is projected outside over the upper side of the engine case so that it can rotate as the crankshaft turns;
- the ignition coil unit is attached to an attachment boss projected at the top on the upper side of the engine case and is arranged on the cylinder head side along the periphery of the flywheel; and
- an ignition cord is provided to connect the spark plug located at the cylinder head to the ignition coil unit.

In the ignition in an internal-combustion engine according to the present invention, a CDI ignition coil unit for a CDI ignition system which is integrally formed of a generator coil, an ignition timing detecting means for detecting the ignition timing based on the rotation of the flywheel and an ignition controller for controlling the ignition timing or a transistor magneto ignition coil unit which is designed to be approximately the same configuration as that of the CDI ignition coil unit, may be used as the ignition coil unit. That is, either ignition coil unit can be mounted. Further, the flywheel to be mounted can be selected in accordance with the ignition type of the ignition coil unit to be mounted. Therefore, the inexpensive transistor magneto ignition system and the high-performance CDI ignition system can be mounted interchangeably on a single engine base. Thus, it is possible to provide multiple models of engines using the same type of engine base, at a sharply reduced manufacturing cost compared to the case where multiple types of engines are manufactured.

The ignition coil unit is configured so that the core portions of the generator coil elements are arranged close to an igniter on both side thereof, sandwiching the igniter when viewed from the top. Further, the core portions of the generator coil elements are positioned outside the flywheel and close to the magnet located on the flywheel at the positions where they oppose the magnet. When the transistor magneto ignition system or CDI ignition system is adopted as the ignition coil unit, either ignition coil unit can be mounted simply by changing the igniter configuration and the positional relationship of the igniter relative to the core portions of the generator coil elements, without significantly changing the mounted positions of the core portions of the generator coil elements and without changing the layout of the other components.

Moreover, in the engine of an outboard motor with the crankshaft arranged approximately vertically and the cylinder portion directed to the rear, the flywheel is fixed at one end of the crankshaft which is projected outside over the upper side of the engine case so that it can rotate as the crankshaft turns while the ignition coil unit is arranged on the cylinder head side along the periphery of the flywheel. Therefore, it is possible to arrange the ignition coil unit at a position close to the spark plug and still within the silhouette of the engine from the top, realizing a space-saving layout. Further, since the ignition coil unit is attached to an attachment boss projected at the top on the upper side of the engine case, it is possible to attach it with simple components.

DESCRIPTION OF THE PREFERRED EMBODIMENTS

The embodiment of the present invention will hereinafter be described in detail with reference to the accompanying drawings.

Figure 1:
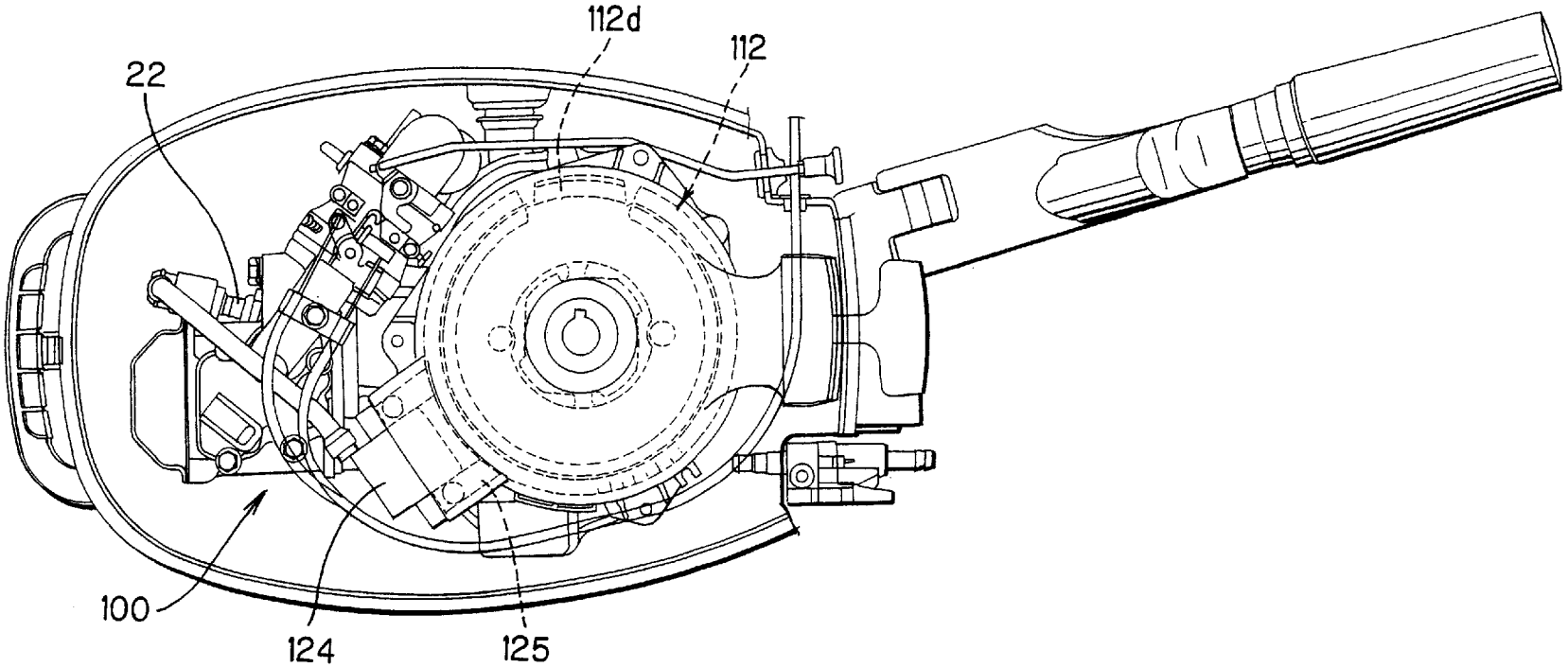
FIG. 1 PRIOR ART
FIG. 1 is a partially sectional plan view showing an engine configuration of a conventional transistor magneto ignition system.
Figure 2:
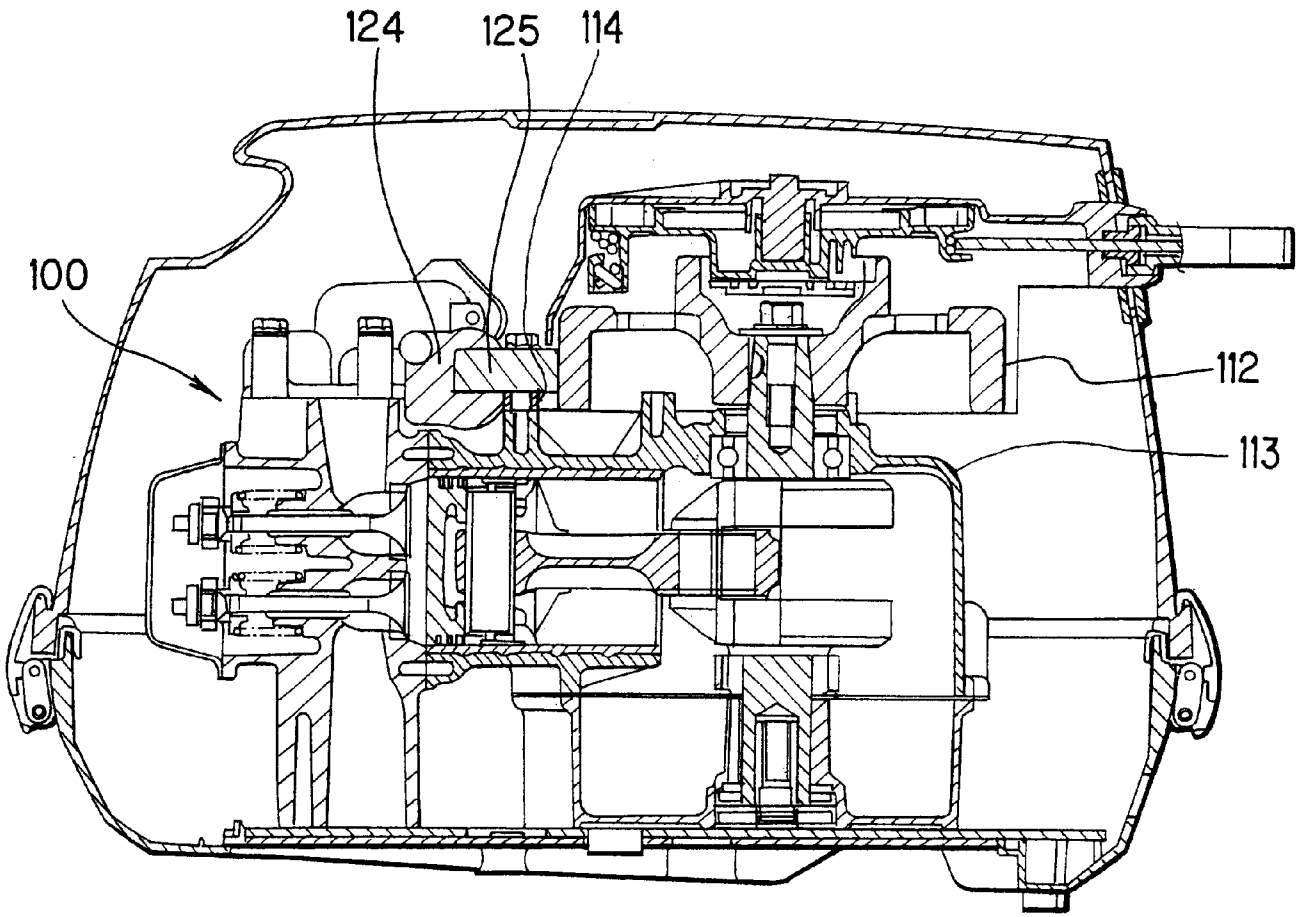
FIG. 2 PRIOR ART
FIG. 2 is a sectional side view showing the above engine configuration.
Figure 3:
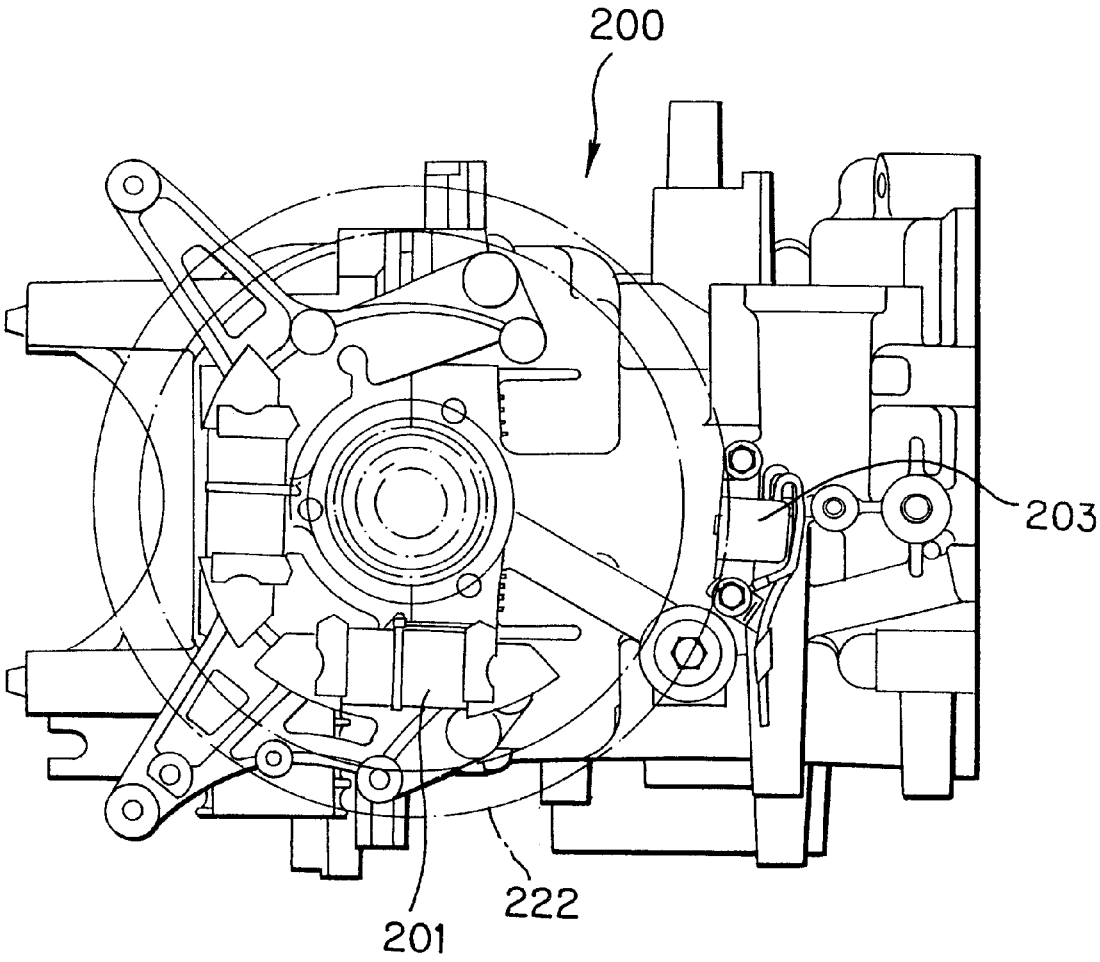
FIG. 3 PRIOR ART
FIG. 3 is a partially sectional plan view showing an engine configuration of a conventional CDI ignition system.
Figure 4:
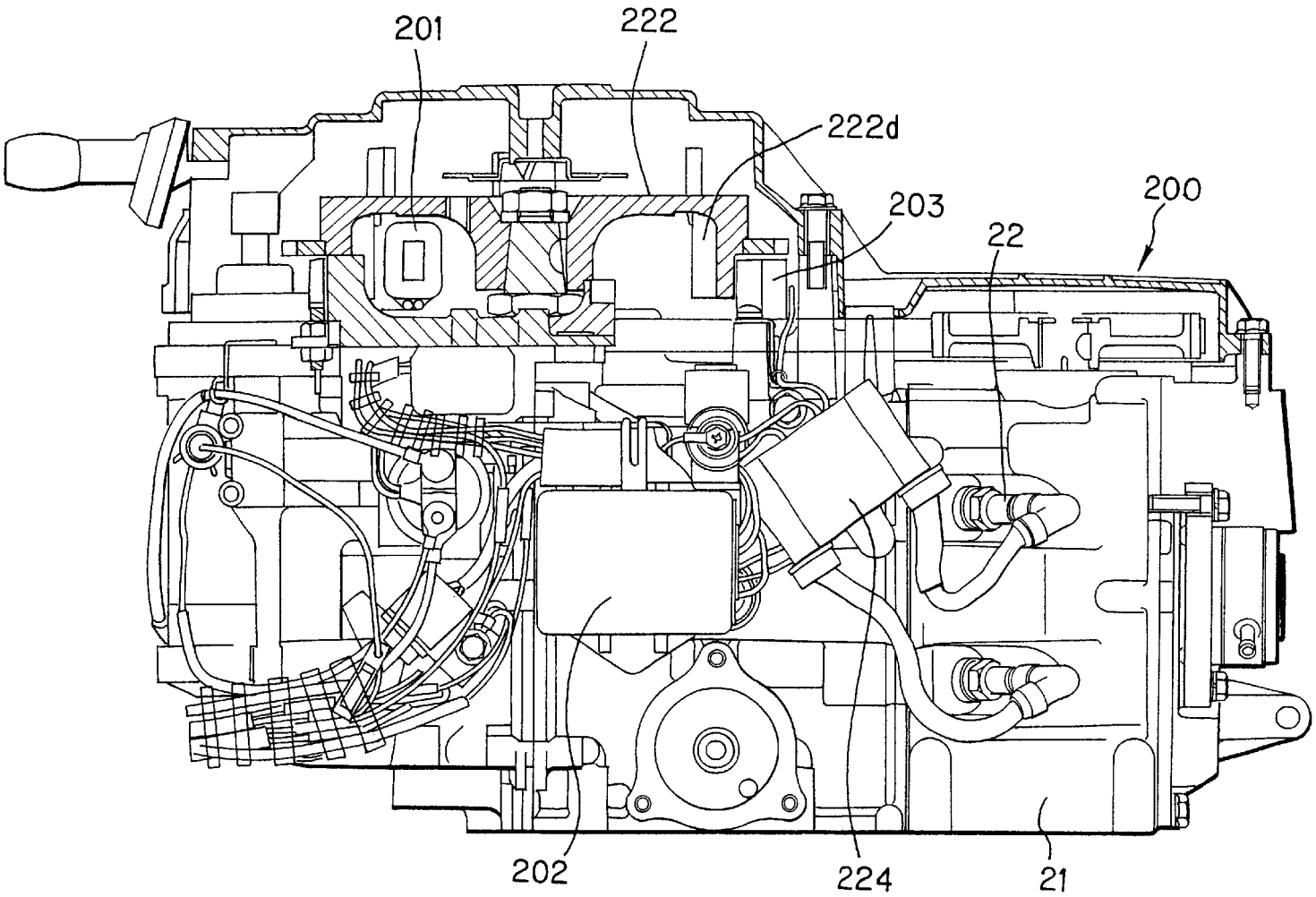
FIG. 4 PRIOR ART
FIG. 4 is a sectional side view showing the above engine configuration.
Figure 5:
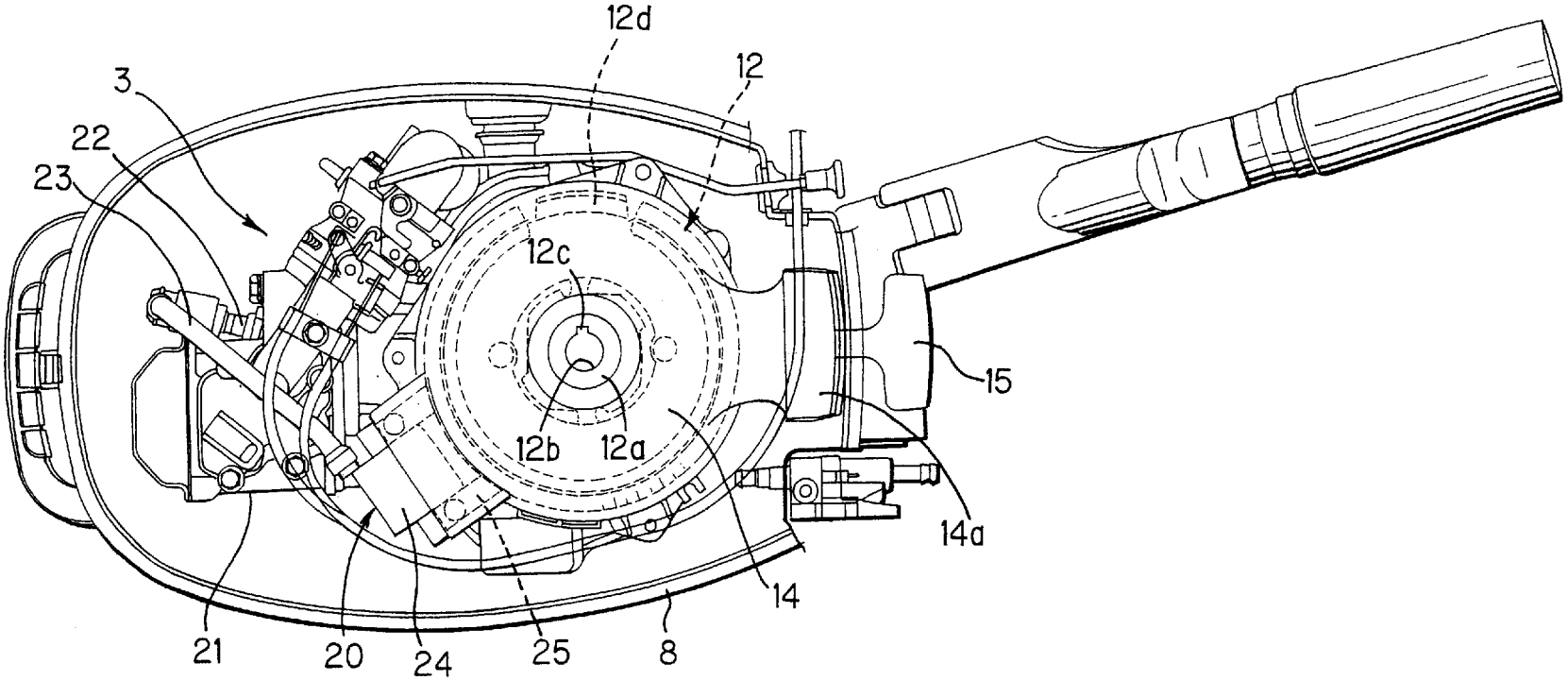
FIG. 5 is a plan view showing an ignition mounting arrangement in an internal-combustion engine in accordance with the embodiment of the present invention.
Figure 6:
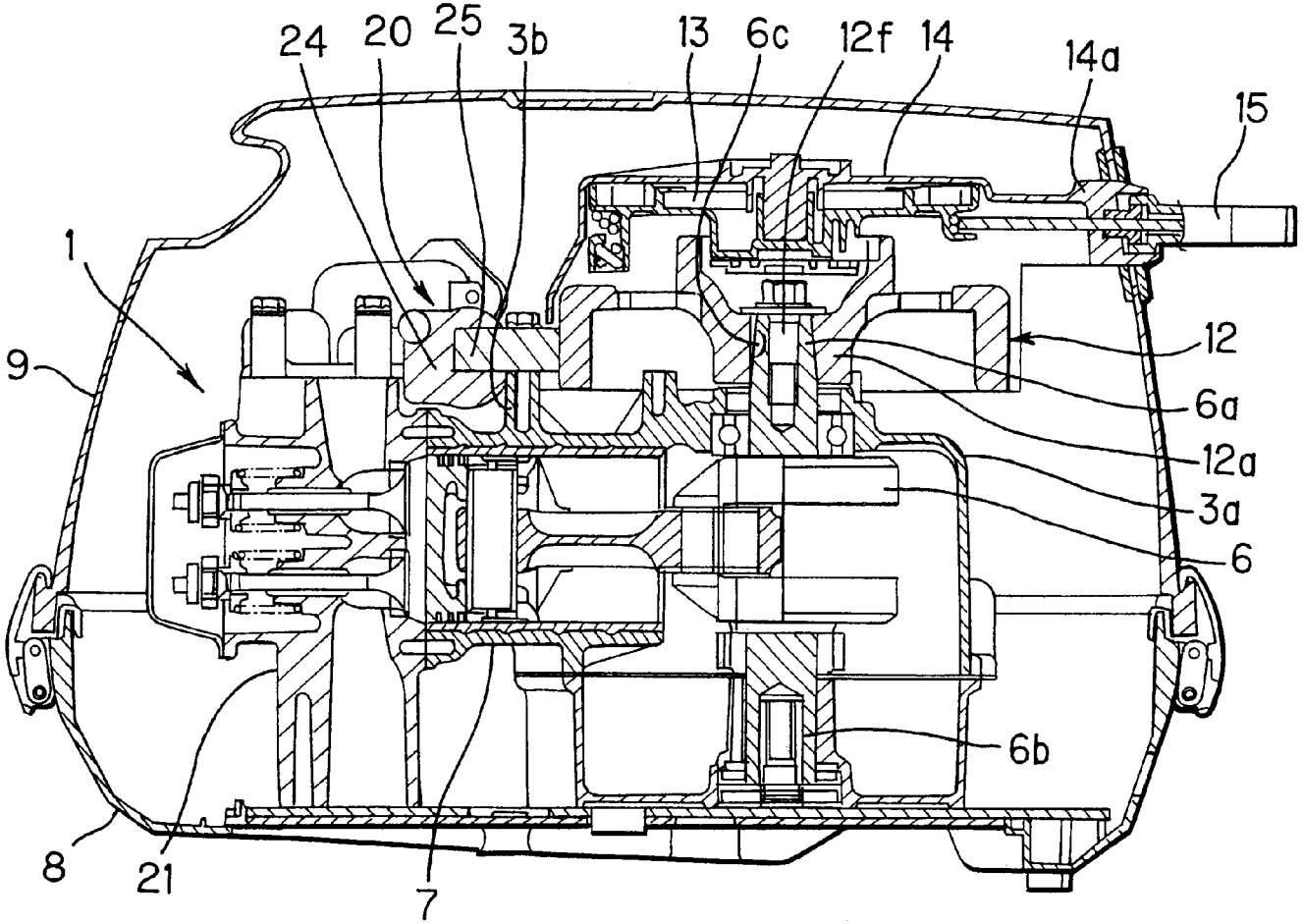
FIG. 6 is a partially sectional side view showing the above engine configuration.
Figure 7:
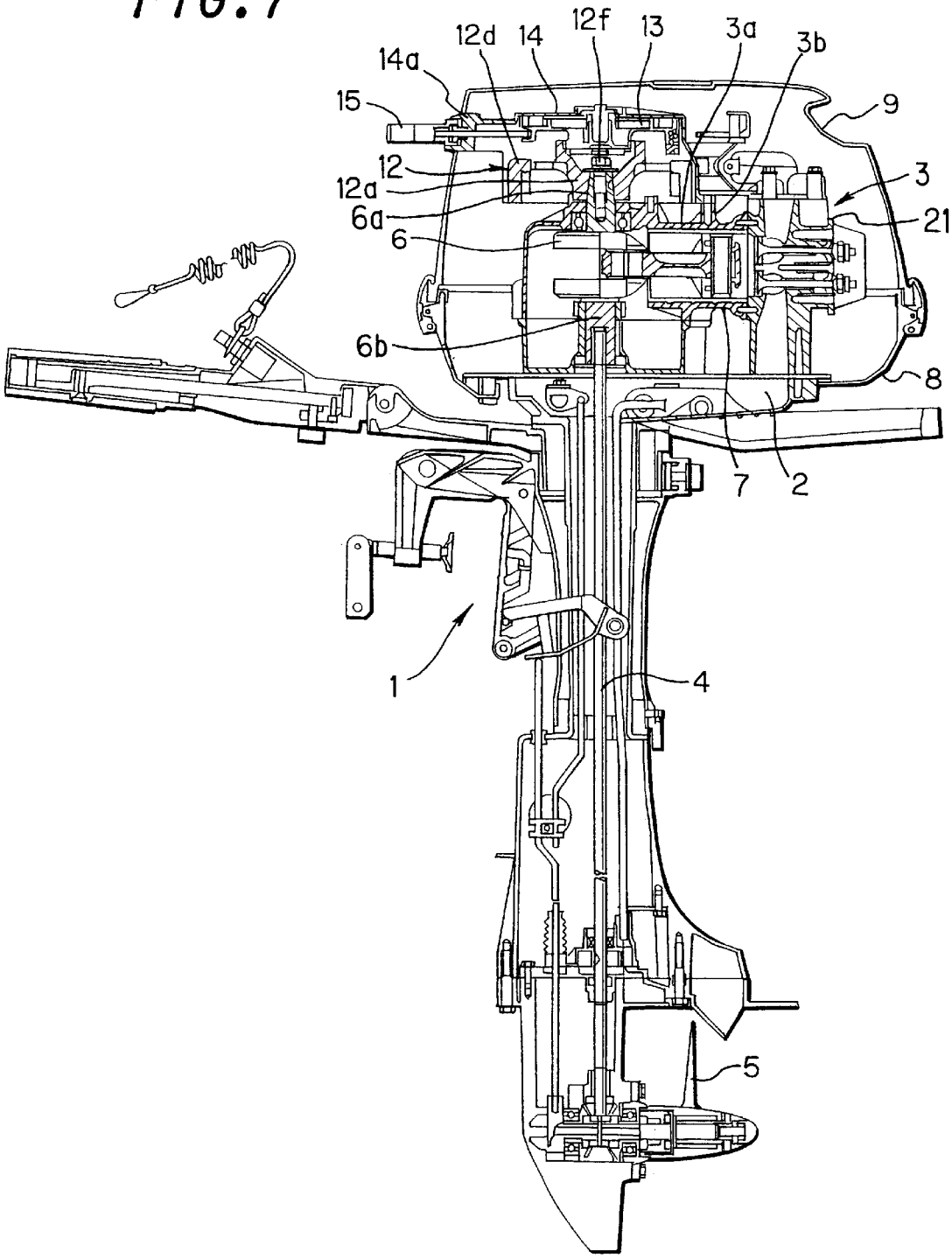
FIG. 7 is a partially sectional side view showing an outboard motor employing the above engine.

FIG. 5 is a partially sectional plan view showing the overall configuration of an engine employing an ignition mounting arrangement in an internal-combustion engine in accordance with the embodiment of the present invention. FIG. 6 is a sectional side view showing the above engine. FIG. 7 is a sectional side view showing the overall configuration of an outboard motor employing the above engine.

An outboard motor 1 according to this embodiment, as is shown in FIGS. 5, 6 and 7, has an engine 3 mounted on a casing 2 located on the stern of a boat and transfers the driving force of the engine 3 to a propeller 5 located at the bottom end of the casing via a driving shaft 4 so as to provide propulsion.

This engine 3 is a four-cycle transverse engine so arranged that its crankshaft 6 is laid in the vertical direction while a cylinder portion 7 of a single cylinder is directed rearwards. The lower side of the engine, or the casing 2 side is enclosed by a lower cowling 8 and the upper side is covered by an upper cowling 9.

Projected outside over the top of an engine case 3*a* of engine 3 is a top end 6*a* of crankshaft 6. A flywheel 12 having an approximately down-opening cup-shape is fastened at the top end of crankshaft 6 by a bolt 12*f* so that it will turn as the crankshaft 6 rotates. On the other hand, the other end 6*b* of crankshaft 6 is coupled to driving shaft 4 near casing 2.

Attached over flywheel 12 is a recoil starter 13 for cranking start of crankshaft 6.

The flywheel 12 and recoil starter 13 are enclosed from their top to side or periphery by a starter cover 14.

The front side, with respect to the direction of travel, of this starter cover 14 is projected frontward and outside upper cowling 9 and a starter handle 15 is attached to its end 14*a*.

The ignition system of the internal-combustion engine, including the flywheel 12 and a CDI ignition coil unit 20, is arranged on the top of engine 3.

Next, the ignition mounting arrangement in the internal-combustion engine will be described.

As shown in FIGS. 5, 6 and 7, the ignition system configuration of the internal-combustion engine according to this embodiment is constructed so that CDI ignition coil unit 20 is directly attached to an attachment boss 3*b* projected at the top on the upper side of engine case 3*a* and is arranged on the cylinder head 12 side in proximity to the periphery of flywheel 12 while an ignition cord 23 is provided to connect a spark plug 22 located at the cylinder head 21 to the CDI ignition coil unit 20.

The flywheel 12 has a boss 12*a* at its center, as shown in FIG. 5 and FIG. 6. This boss 12*a* has an attachment bore 12*b* into which crankshaft 6 is fitted. The attachment bore 12*b* is formed with a key slot 12*c*, which, in cooperation with a key 6*c*, positions flywheel 12 at a predetermined position on crankshaft 6.

Further, the flywheel 12 has a magnet 12*d* in part on the outer peripheral side or at a predetermined angular position based on the ignition timing so that the magnet will pass over the range where an aftermentioned generator unit of CDI ignition coil unit 20 is disposed.

Figure 8:
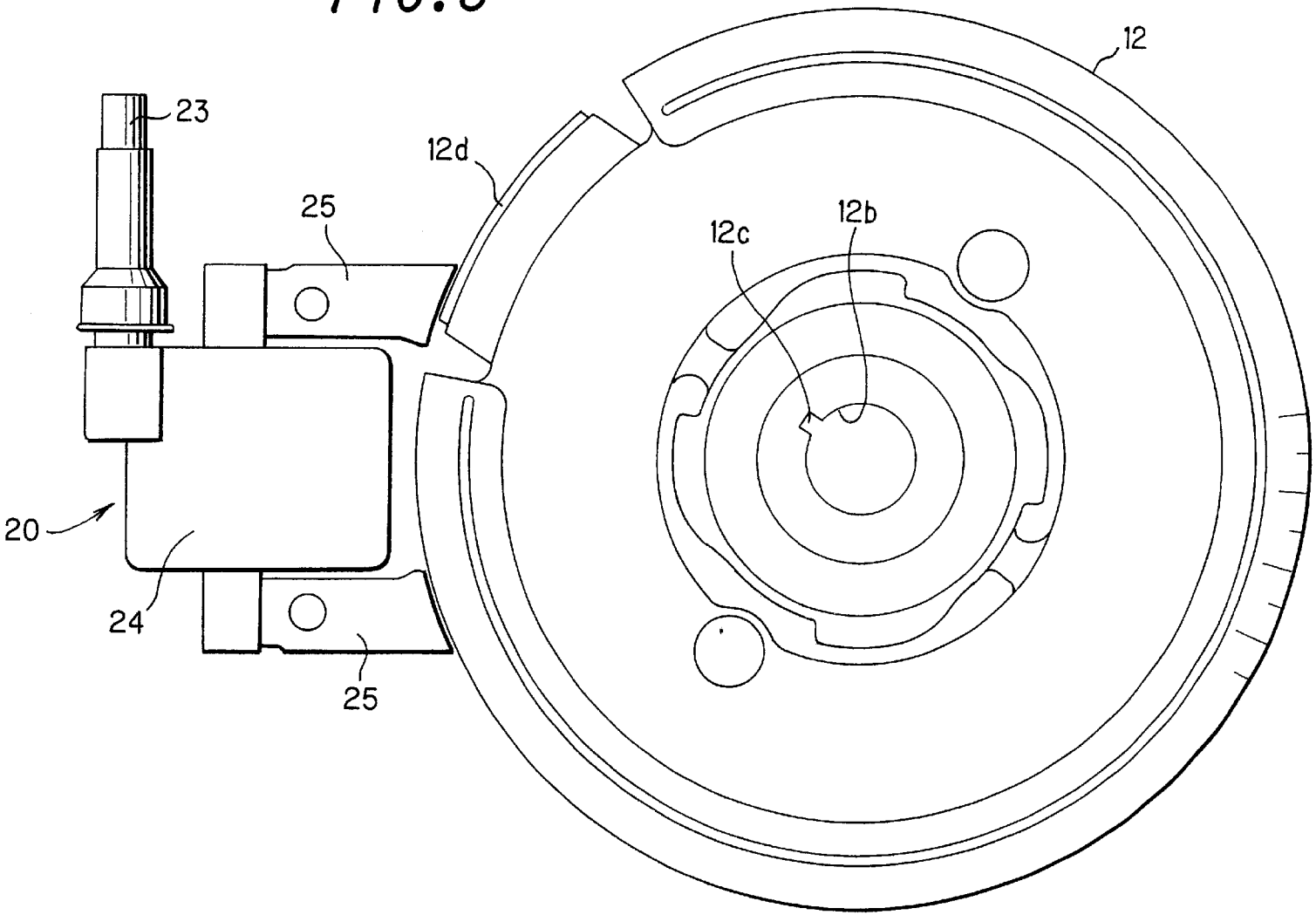
FIG. 8 is an illustrative view showing the mounted state of a flywheel and igniter according to the present embodiment.

The CDI ignition coil unit 20, as shown in FIG. 8, has an igniter 24 which includes as a module an exciter coil (not shown) which is excited by the rotation of flywheel 12, a pickup coil (not shown) for detecting the ignition timing and a control unit (not shown) for setting up the ignition timing. The unit 20 further includes a pair of core portions 25 of a core portions of a generator coil which are arranged substantially parallel to each other on both sides of igniter 24 so as to sandwich the igniter 24, when viewed from the top.

These core portions 25 are arranged at positions outside flywheel 12, opposing magnet 12*d* located at the periphery of flywheel 12 and closer to the magnet 12*d* than igniter 24.

Sparking of engine 3 of this embodiment is effected by generating a voltage from the generator coil in igniter 24 as flywheel 12 turns, controlling the voltage by the control unit in the igniter and outputting the high voltage to spark plug 22 via ignition cord 23.

Figure 9A:
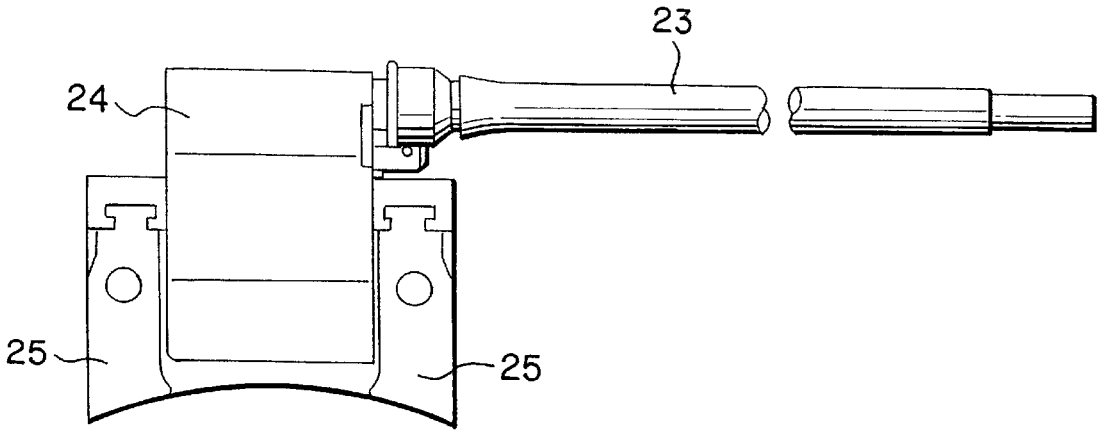
FIG. 9A is a plan view showing an igniter configuration of CDI ignition according to the present embodiment.
Figure 9B:
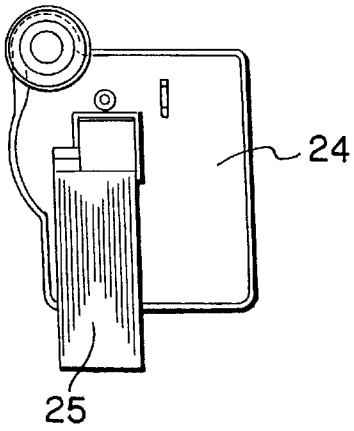
FIG. 9B is a side view showing the above igniter configuration; and, FIG. 10A is a plan view showing an igniter configuration of transistor magneto ignition according to the present embodiment.
Figure 10A:
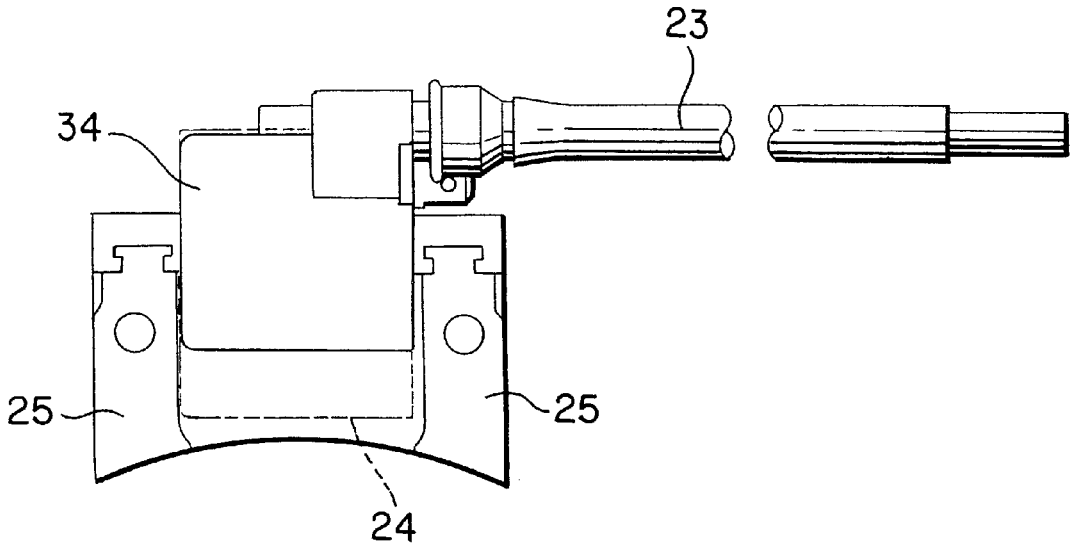
FIG. 10B is a side view showing the above igniter configuration.
Figure 10B:
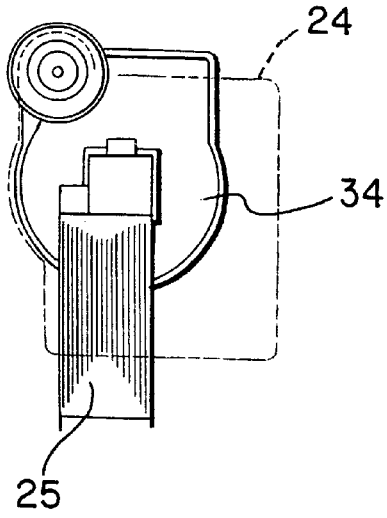

According to the present embodiment configured as above, since CDI ignition coil unit 20 is integrally formed of an exciter coil, pickup coil and control unit so as to configure igniter 24 (see FIGS. 9A and 9B) having substantially the same shape as that of a transistor magneto type igniter 34 (see FIGS. 10A and 10B), it is possible to provide an ignition configuration of CDI ignition by using the analogous layout of the conventional transistor magneto ignition system.

Further, since the layout is designed to be analogous to that of a transistor magneto ignition system as above, it is possible to change the ignition system into that of a transistor magneto ignition by changing the igniter and flywheel, whereby it is possible to provide multiple ignition systems in accordance with the necessary engine characteristics, based on the same type of engine base.

In the present embodiment, attachment of flywheel 12 on crankshaft 6 is positioned and fixed using attachment key 6*c* while magnet 12*d* is arranged at the periphery of the flywheel 12. Therefore, a flywheel of an identical shape which is different only in key slot position can be used when the ignition mode is changed because both the transistor magneto ignition type and the CDI ignition type use a flywheel having a magnet at the periphery thereof.

Thus, a simple change in arrangement makes it possible to adopt either the transistor magneto ignition system or the CDI ignition system. Further, since the cost for die of the flywheel can be reduced and since all the procedures prior to the production step of the flywheel are the same, management cost can be reduced.

As described heretofore, according to the ignition mounting arrangement in an internal-combustion engine of the present invention, use of an igniter of a CDI ignition coil unit which is substantially analogous in shape to that of transistor magneto ignition by integrally constructing an exciter coil, pickup coil and control unit into one module, makes it possible to provide a system arrangement of the same layout as that of transistor magneto ignition.

By this feature, it becomes possible to provide either CDI ignition type or transistor magneto ignition type, based on the same type of engine base.

More specifically, for a case where ignition timing may be fixed by giving priority to the cost, the engine configuration of transistor magneto ignition which is inexpensive can be adopted. On the other hand, when it is necessary to provide a high-power engine by controlling the ignition timing, or when an engine needs to have multiple functions such as oil warning, overspeed governor, etc., it is possible to provide a high-performance engine using CDI ignition, at a reduced cost.

Finally, the present invention also makes it possible to modify the ignition system of an existing engine. That is, it is possible to modify the ignition system of the engines which have been already sold, from the transistor magneto ignition system into the CDI ignition system, to make some improvements on the engine performances such as increase in power, exhaust gas treatment, etc., without changing the engine base. In conclusion, it is possible to provide an ignition mounting arrangement which is excellent in the reduction of costs and resources.

What is claimed is:

1. An ignition mounting arrangement in an internal-combustion engine, wherein a CDI ignition coil unit comprises:

a flywheel with a magnet;

a generator coil;

an ignition timing detecting means for detecting an ignition timing based on the rotation of the flywheel;

an ignition controller for controlling the ignition timing;

wherein the flywheel is disposed at one end of the crankshaft;

wherein voltage generated by the generator coil as the flywheel turns and the ignition timing detected by the ignition timing detecting means are controlled by the ignition controller so as to output a high voltage to a spark plug;

wherein the CDI ignition coil unit comprises an igniter which is integrally configured of the generator coil, the ignition timing detecting means and the ignition controller;

wherein the igniter includes a pair of core portions of the generator coil, the core portions being arranged substantially parallel to sandwich the igniter therebetween, thereby providing the igniter with an analogous layout to a transistor magneto ignition type coil unit to facilitate changing the ignition system into an engine having a transistor magneto ignition system, and the flywheel to be mounted can be selected in accordance with the CDI ignition type coil unit.

2. The ignition mounting arrangement in the internal-combustion engine according to claim 1, wherein the engine is used as an outboard motor with the crankshaft arranged approximately vertically and a cylinder portion rearwardly directed;

wherein the flywheel is fixed at one end of the crankshaft, the flywheel projecting beyond an upper side of an engine case so that the flywheel can rotate as the crankshaft turns;

wherein the ignition coil unit is attached to an attachment boss which projects at a top upper side of the engine case, the ignition coil unit being arranged on a cylinder head side along a periphery of the flywheel; and wherein an ignition cord connects the spark plug to the ignition coil unit, the spark plug being located at the cylinder head.

* * * * *